United States Patent [19]

Okuda

[11] Patent Number: 4,542,758

[45] Date of Patent: Sep. 24, 1985

[54] UMBRELLA

[75] Inventor: Toshio Okuda, Hirakata, Japan

[73] Assignee: Ming Nan Wu, Hsin Chu, Taiwan

[21] Appl. No.: 510,951

[22] Filed: Jul. 5, 1983

Related U.S. Application Data

[63] Continuation of Ser. No. 205,387, Nov. 10, 1980, abandoned.

[51] Int. Cl.[4] ..... A45B 19/10

[52] U.S. Cl. ..... 135/25 R

[58] Field of Search ..... 135/20 R, 25 R, 25 A, 135/28, 33

[56] References Cited

U.S. PATENT DOCUMENTS

| | | | |
|---|---|---|---|
| 3,431,925 | 3/1969 | Kraft | 135/25 R |
| 3,593,731 | 7/1971 | Schultes | 135/25 R |
| 3,638,668 | 2/1972 | Kida | 135/20 |

FOREIGN PATENT DOCUMENTS

| | | | |
|---|---|---|---|
| 1801439 | 5/1970 | Fed. Rep. of Germany | 135/20 R |
| 2527822 | 1/1977 | Fed. Rep. of Germany | 135/25 R |
| 98193 | 3/1923 | Switzerland | 135/25 R |

*Primary Examiner*—Harland S. Skogquist

[57] ABSTRACT

An umbrella which may be folded into a form of a flat box includes a fixed capstan and a slide capstan which form a flat rectangle. The short edges of the rectangle may be rounded, if desired, the capstans then having an elongated shape. The fixed and slide capstans are provided with notches or grooves on their short edges, which radiate outwardly for the insertion of the ends of the struts. Additional notches or grooves extending generally between the opposing long edges of the capstans are provided for the insertion of additional ends of the struts. The capstans further include annular channels on their peripheries which intersect the notches. A wire is disposed in each annular channel and each wire penetrates through apertures formed in the ends of the struts to retain the struts and to permit them to rotate within the notches or grooves when opening and closing the umbrella.

12 Claims, 8 Drawing Figures

PRIOR ART
Fig. 1
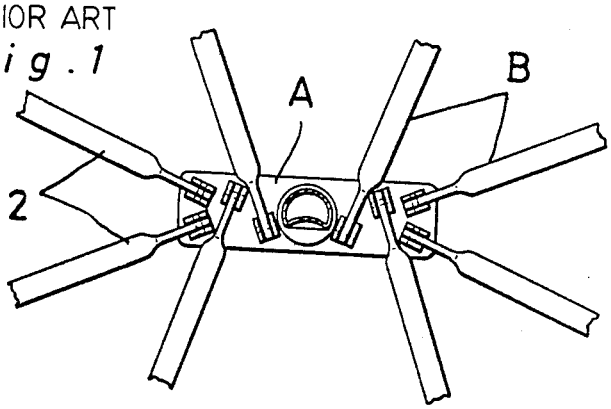
PRIOR ART
Fig. 2
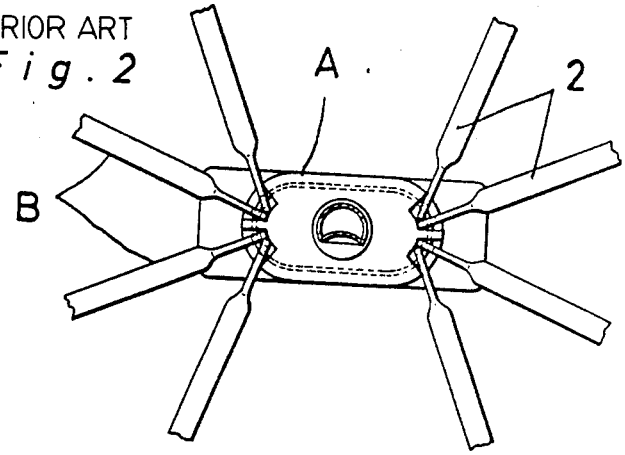
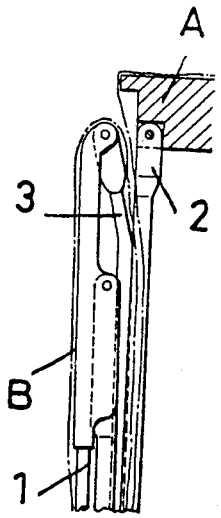
Fig. 4
PRIOR ART

UMBRELLA

This is a continuation of co-pending application Ser. No. 205,387, filed Nov. 10, 1980, now abandoned.

BACKGROUND OF THE INVENTION

This invention relates to an umbrella which may be folded into a form of a flat generally rectangular box-like shape.

In a conventional umbrella of this type as shown in FIGS. 1 or 2, the roof rods (B) are pivotally connected to the opposing edges of the rectangular capstan (A) and are generally equally spaced in order to reduce the thickness of the flat rectangular box box-like shape of the folded umbrella. However, as shown in FIGS. 3 and 4, the ends of the roof rods (B), and the pivot joint part of the roof rod, which couples the end of the front roof rod (1) to the end of link (3), will protrude beyond the peripheral edge of the fixed capstan (A) when the umbrella is in its folded position.

It is a purpose of the present invention to provide an improved umbrella in which the pivot joint part connected the front roof rod and the link need not protrude beyond the capstan when the umbrella is folded, and thereby a reduction of the thickness between the long edges of the capstan can be attained.

Further advantages and details of the subject matter of the invention will now be described with reference to an embodiment of the invention shown in the accompanying drawings.

FIGS. 1–2 are schematic views showing the arrangements of the conventional roof rods and struts;

FIG. 4 is a longitudinal sectional view of the roof rods and struts of FIG. 2 in the folded condition;

DESCRIPTION OF THE PREFERRED EMBODIMENTS

Figure 5:
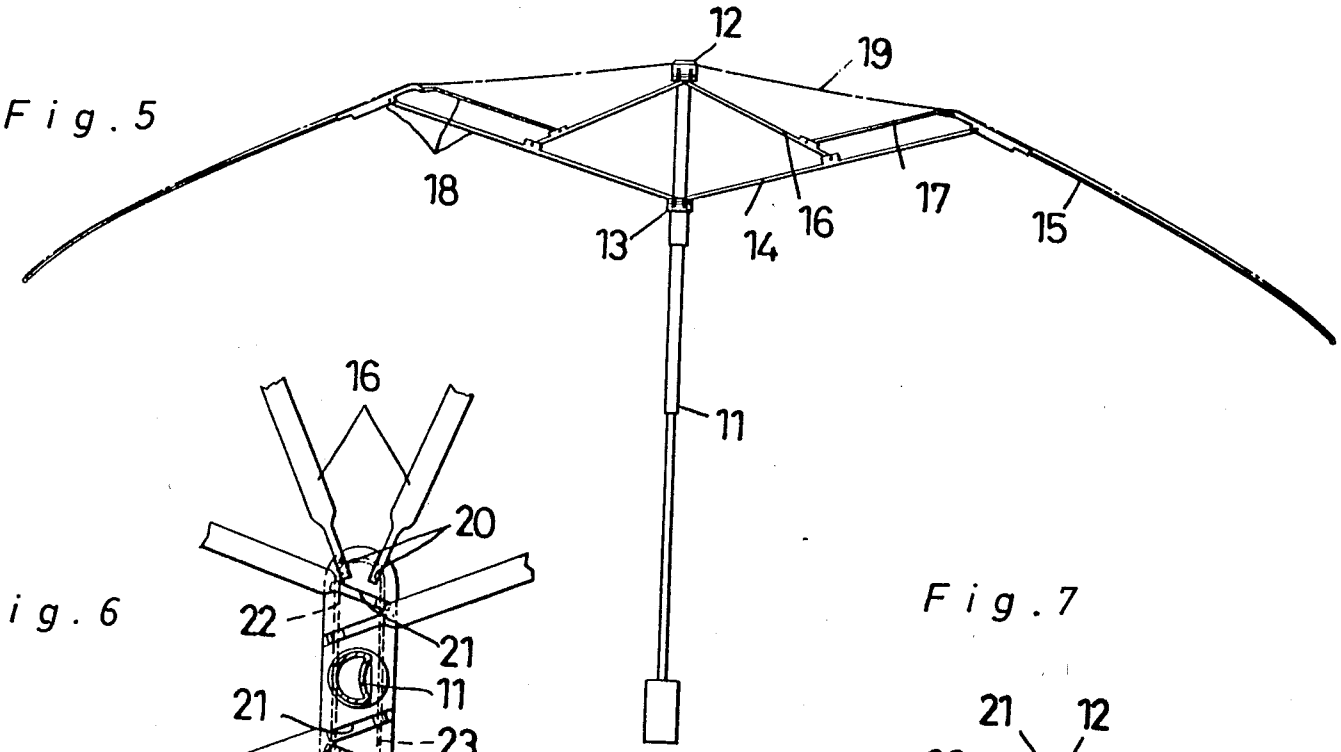
FIG. 5 is a front elevational sectional view of an umbrella in accordance with the present invention which is in an open position.

Referring now to the drawings, particularly to FIG. 5, there is shown an umbrella having a telescopic stick 11; a fixed capstan 12 secured on the upper end of the stick 11; and a slide capstan 13 adapted to slide on the stick. Slide capstan 13 may be held in a desired position when the umbrella is opened, for instance. A plurality of struts 14 are provided having one end pivotally connected to the slide capstan 13. A plurality of roof rods 15 support material 15 and are pivotally connected to the other end of struts 14. A plurality of struts 16, at the ends thereof, are pivotally connected to fixed capstan 12 and intermediate the ends of struts 14. A plurality of links 17 are pivotally connected near lower end of struts 16 and at the upper end of the roof rods 15, each link 17 being disposed essentially parallel to its associated strut 14. Material 19 forms the roof of the umbrella and has its center secured on the fixed capstan 12, and its periphery fixed on the free ends of the roof rods 15. Each arm

18 of the umbrella preferably includes one strut 14, one strut 16, a roof rod 15 and a link 17.

The fixed and slide capstans 12, 13 are generally formed in as flat rectangles. They are provided with respective downward and upward opening notches 20 on their short edges, which radiate outwardly, for insertion of the ends of the struts 16, 14. The fixed and slide capstan 12, 13 are also provided with respective downward and upward opening notches 21 which essentially extend between their opposing long edges as can be better seen in FIG. 7. Notches 21 similarly receive the ends of the struts 16, 14.

The fixed and slide capstans 12, 13 are each provided with an annular channel 22 at the periphery thereof which intersects notches 20 and 21. A pivot wire 23 is disposed in each channel 22 and penetrates through an aperture formed in the ends of the struts 16 and 14. Alternatively, on both ends of the capstans, separate wires may be used for pivotally connecting the ends of the struts 16, 14.

Figure 6:
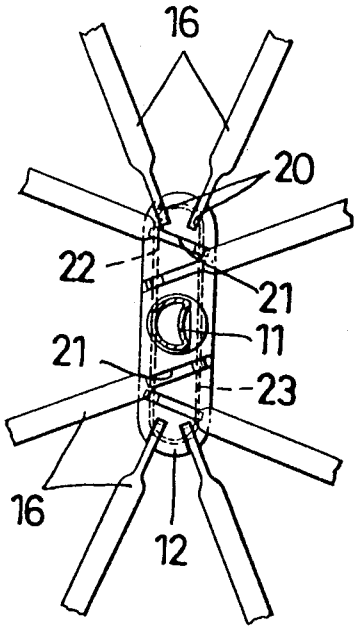
FIG. 6 is a cross sectional view of the main part of the umbrella of FIG. 5.

Assuming the umbrella is equipped with eight umbrella arms 18 as shown in the depicted embodiment, two notches 20 are preferably provided at each short edge along with four notches 21 in the capstans 12, 13 as shown in FIG. 6. Of course, only one notch 20 on each short end is required for an umbrella having six arms 18.

Figure 3:
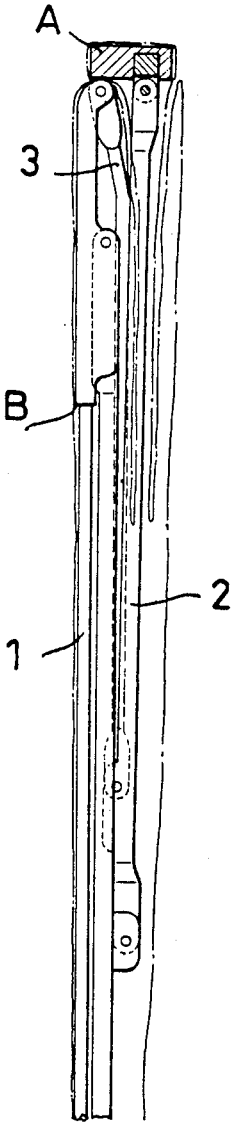
Fig. 3 PRIOR ART
FIG. 3 is a longitudinal sectional view of the roof rods and struts of FIG. 1 in the folded condition.
Figure 8:
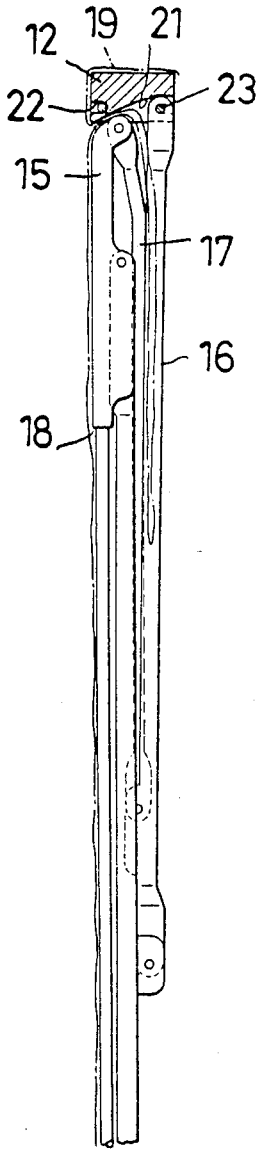
FIG. 8 is a longitudinal sectional view of an umbrella in accordance with the present invention which is in a folded condition.
Figure 7:
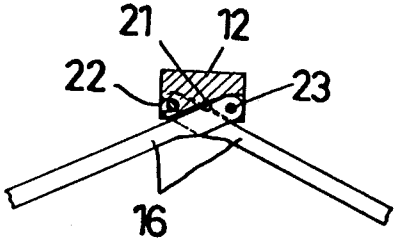
FIG. 7 is a longitudinal sectional view of the main part of the umbrella of FIG. 5.

The assembly of the struts 16, 14 of the fixed and slide capstans 12, 13 will now be described. The pivot joint of the struts 16 and 14 is formed in the manner that the ends of the struts 16, 14 coming from different directions are inserted into the notches 20 and 21 respectively, and wire 23 is inserted through the ends of the struts 16, 14, and engaged with the groove 22. As can be seen in FIG. 7, the pivoting points of the struts 16, 14 in the notches 21 are held very near the long edges of the capstans 12, 13. Hence, when the umbrella arms 18 are in their folded condition, the pivot joint part of the roof rod 15 which then is parallel to the strut 16 and the link 17 need not protrude beyond the long edges of the capstans 12 and 13 as shown in FIG. 8. Therefore, the thickness of the folded umbrella struts will be equal to the width of the fixed capstan between its opposing long edges, and be thinner the prior art embodiments shown in FIGS. 3 and 4.

What is claimed is:

1. An umbrella comprising: an elongate rectangular shaped fixed capstan and an elongate rectangular shaped sliding capstan; an elongate member passing between said fixed capstan and said sliding capstan; and more than two arms pivotally coupled to the peripheries of said fixed capstan and said sliding capstan and movable between an open position and a closed position, at least selected ones of said arms extending from their points of attachment on said capstans toward the opposing peripheries of said fixed capstan and said sliding capstan when in the closed position, two of said arms being pivotally coupled to said capstans more closely to said elongated member than the remaining ones of said arms and said two arms being pivotally coupled on opposite peripheries of said capstans; and further comprising grooves located in the fixed capstan and the sliding capstan, said grooves being arranged to receive ends of the arms, which grooves extend from each of the longer sides of the fixed capstan and the sliding capstan to the respective opposite longer sides with the grooves of one longer side lying alternately with the grooves of the opposite longer side.

2. The umbrella according to claim 1, wherein said fixed capstan has a generally planar surface on the side thereof opposite said notches or grooves, said notches or grooves having two essentially parallel sidewalls and a floor bottom, the floor bottom being nonparallel to said planar surface.

3. The umbrella according to claim 1, wherein said arms include at least two struts and a roof rod, the roof rod being coupled near one end thereof to one of said struts, one of said struts being pivotally coupled to said sliding capstan and the other of said struts being pivotally coupled to said fixed capstan and further including material supported by said rod and attached to the other end of said rods.

4. The umbrella according to claim 1, wherein said sliding capstan is movably mounted on said member, said sliding capstan being similar to said fixed capstan, said sliding capstan being mounted on said member so that the notches or grooves therein are disposed in confronting relationship to the notches or grooves in said fixed capstan.

5. The umbrella according to claim 4 further including a channel in the peripheral edge of said capstans, said channel intersecting each of said notches or grooves.

6. The umbrella according to claim 5, wherein the portions of said arms disposed in said notches or grooves include apertures therein and wherein a wire is disposed in said channel and through said apertures.

7. An umbrella comprising a shaft, an elongate rectangular shaped crown fixed to one end of the shaft, an elongate rectangular shaped slider mounted on and movable along the said shaft, major surfaces of the crown and slider each extending perpendicularly of the longitudinal axis of the shaft, a plurality of arms pivotally coupled to said crown, a further plurality of arms pivotally interconnected with the first mentioned arms and pivotally coupled to said slider adjacent the peripheral edges thereof for effecting movement of the umbrella between open and closed positions, grooves located in the crown and slider being arranged to receive ends of the said arms, which grooves extend from each of the longer sides of the crown and slider to the respective opposite longer sides with the grooves of one longer side lying alternately with the grooves of the opposite longer side, a channel in the peripheral edge of each of the crown and slider, which channel interconnects said grooves of the crown and slider, respectively, and means located in the channels on which the said arms are pivotally coupled to said crown and slider whereby in the closed position of the umbrella the arms do not protrude beyond the peripheral edge of the crown.

8. An umbrella as claimed in claim 7, wherein said arms include a plurality of struts and a cover support rib, the rib being coupled near one end thereof to one of said struts, another one of said struts being pivotally coupled to said slider and a further one of said struts being pivotally coupled to said crown, said one strut and said another strut, and wherein the cover is connected to the end of the rod remote from the end near which the one strut is connected.

9. An umbrella as claimed in claim 7, wherein said crown has a generally planar surface on the side thereof opposite said grooves, said grooves each having two parallel sidewalls and a bottom surface, the bottom surface being nonparallel to said planar surface.

10. An umbrella as claimed in claim 7, wherein the portions of said arms disposed in said grooves include apertures therein for pivotally mounting the arms.

11. An umbrella as claimed in claim 10, wherein said means in the channel is a wire disposed in the channel and passing through said apertures.

12. An umbrella as claimed in claim 11, wherein the wire in the channel links each of the struts associated with the crown and slider, respectively.

* * * * *